US008696381B2

(12) United States Patent
Chang et al.

(10) Patent No.: US 8,696,381 B2
(45) Date of Patent: Apr. 15, 2014

(54) ELECTRICAL CONNECTOR AND METHOD OF MAKING THE SAME

(75) Inventors: Yen-Chih Chang, New Taipei (TW); Ke-Hao Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 40 days.

(21) Appl. No.: 13/589,093

(22) Filed: Aug. 18, 2012

(65) Prior Publication Data

US 2013/0052877 A1 Feb. 28, 2013

(51) Int. Cl.
*H01R 13/648* (2006.01)

(52) U.S. Cl.
USPC ..... 439/607.02; 29/883

(58) Field of Classification Search
USPC ..... 439/86, 88, 91, 607.02; 29/883
See application file for complete search history.

(56) References Cited

U.S. PATENT DOCUMENTS

| | | | | |
|---|---|---|---|---|
| 6,123,584 | A * | 9/2000 | Van Koetsem et al. | 439/607.02 |
| 6,179,663 | B1 * | 1/2001 | Bradley et al. | 439/607.02 |
| 6,544,072 | B2 * | 4/2003 | Olson | 439/607.02 |
| 8,109,770 | B2 * | 2/2012 | Perugini et al. | 439/74 |
| 2003/0236031 | A1 * | 12/2003 | Perugini et al. | 439/607 |
| 2004/0166704 | A1 * | 8/2004 | Perugini et al. | 439/74 |
| 2004/0192089 | A1 * | 9/2004 | Perugini et al. | 439/92 |
| 2006/0121757 | A1 * | 6/2006 | Chung et al. | 439/91 |
| 2009/0156028 | A1 * | 6/2009 | Bumb et al. | 439/91 |
| 2012/0258616 | A1 * | 10/2012 | Mason et al. | 439/88 |
| 2013/0052877 | A1 * | 2/2013 | Chang et al. | 439/626 |

FOREIGN PATENT DOCUMENTS

| | | |
|---|---|---|
| CN | 201498709 | 6/2010 |

* cited by examiner

*Primary Examiner* — Ross Gushi
(74) *Attorney, Agent, or Firm* — Wei Te Chung; Ming Chieh Chang

(57) ABSTRACT

An electrical connector (100) for electrically connecting an IC package with a substrate includes a number of conductive contacts (4), a number of grounding terminals (5), an insulative member (32) made of insulation materials locates around the conductive contacts (4) with insert-molded method and an electrical member (1) made of electrical resin locates around the insulative member (32) and the grounding terminals (5) with insert-molded method, the conductive contacts (4) are insulated from the electrical member (1) and the grounding terminals (5) are electrically connected with the electrical member (1).

20 Claims, 5 Drawing Sheets

ELECTRICAL CONNECTOR AND METHOD OF MAKING THE SAME

BACKGROUND OF THE INVENTION

1. Field of the Invention

The present invention relates to an electrical connector and method of making the same, and more particularly to an electrical connector using insert-molded method to position conductive contacts and grounding terminals.

2. Description of Related Art

Chinese patent No. 201498709 issued to Chang on Jun. 2, 2010 discloses a conventional electrical connector for electrically connecting an IC package with a substrate. The electrical connector includes a base with a number of conductive contacts and a number of grounding terminals received therein. The base is made of copper or similar conductive materials. There is an insulation member locating around the conductive contact to insulate the conductive contact and the base. The grounding terminals contact with the base to establish an electrical path. Due to the base is made of copper and also need to manufacture a number of holes to receive the conductive contacts and the grounding terminals, thus made the electrical connector high-cost.

Hence, it is desirable to provide an improved electrical connector to overcome the aforementioned disadvantages.

SUMMARY OF THE INVENTION

Accordingly, an object of the present invention is to provide an electrical connector using insert-molded method to position conductive contacts and grounding terminals.

According to one aspect of the present invention, an electrical connector for electrically connecting an IC package with a substrate comprises a number of conductive contacts, a number of grounding terminals, an insulative member locates around the conductive contacts with insert-molded method and an electrical member locates around the insulative member and the grounding terminals with insert-molded method. The insulative member is made of insulation materials. The electrical member is made of electrical resin. The conductive contacts are insulated from the electrical member and the grounding terminals are electrically connected with the electrical member.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 4:
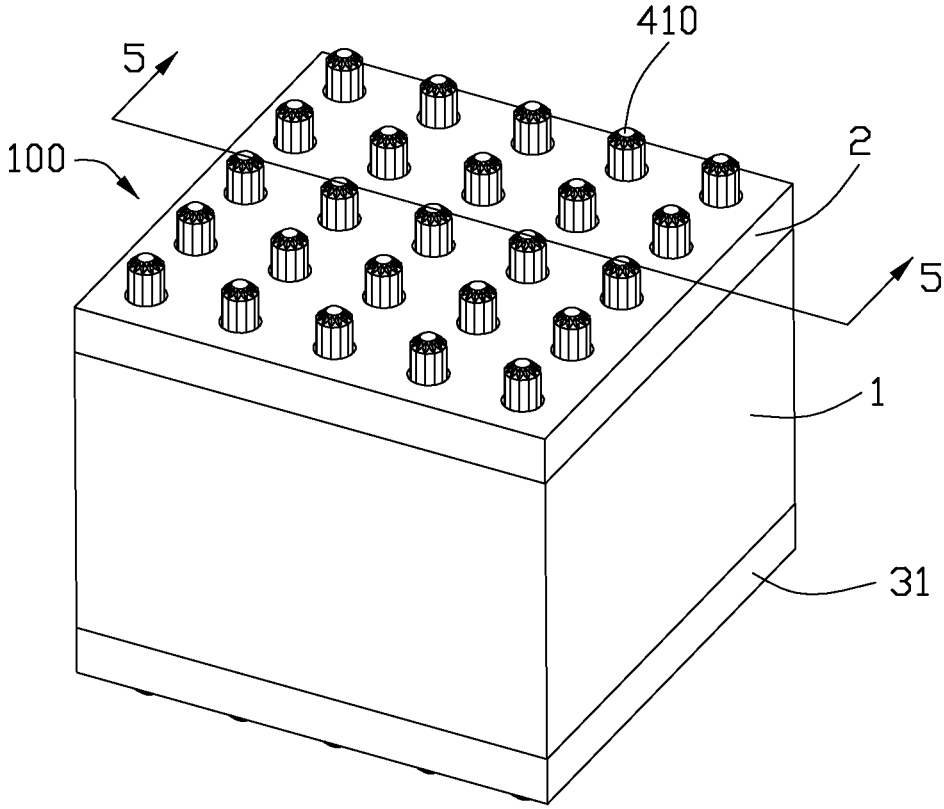
FIG. 4 is an isometric view of an electrical connector according to a preferred embodiment of the present invention.
Figure 5:
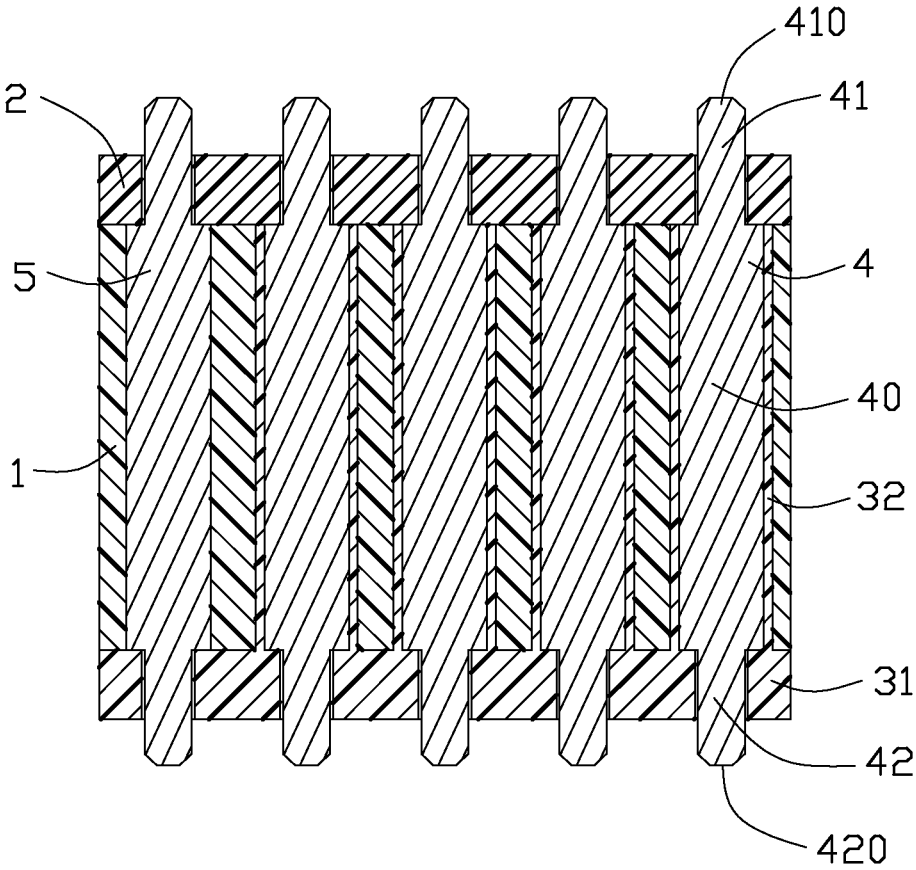
FIG. 5 is a cross-sectional view of the electrical connector taken along line 5-5 in FIG. 4.

FIGS. 4 to 5 illustrate an electrical connector 100 in accordance to a preferred embodiment of the present invention, the electrical connector 100 is used for electrically connecting an IC package (not labeled) with a substrate (not labeled). The electrical connector 100 comprises a number of conductive contacts 4, a number of grounding terminals 5, an insulative member 32 located around the conductive contacts 4, an electrical member 1 made of electrical resin located around the insulative member 32 and the grounding terminals 5. The electrical connector 100 also comprises an upper insulative member 2 locates on upper end of the electrical member 1 and a lower insulative member 31 locates on lower end of the electrical member 1. The electrical resin is made of liquid crystal polyester.

Figure 1:
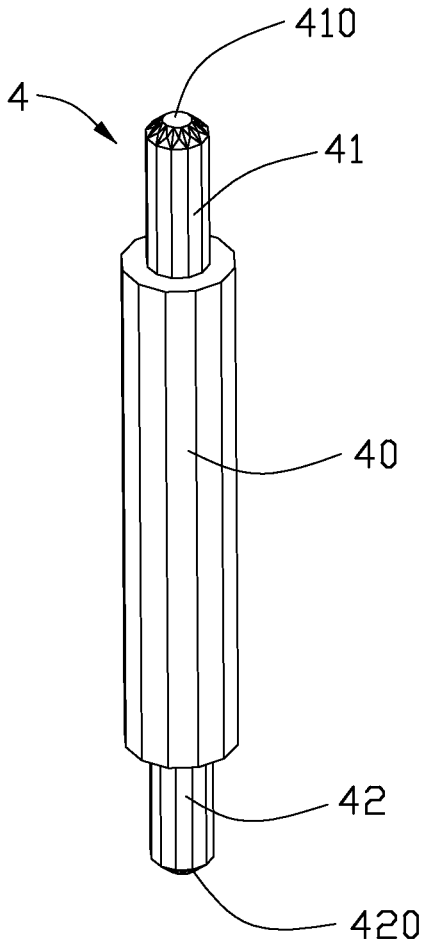
FIG. 1 is an isometric view of a conductive contact according to a preferred embodiment of the present invention.
Figure 2:
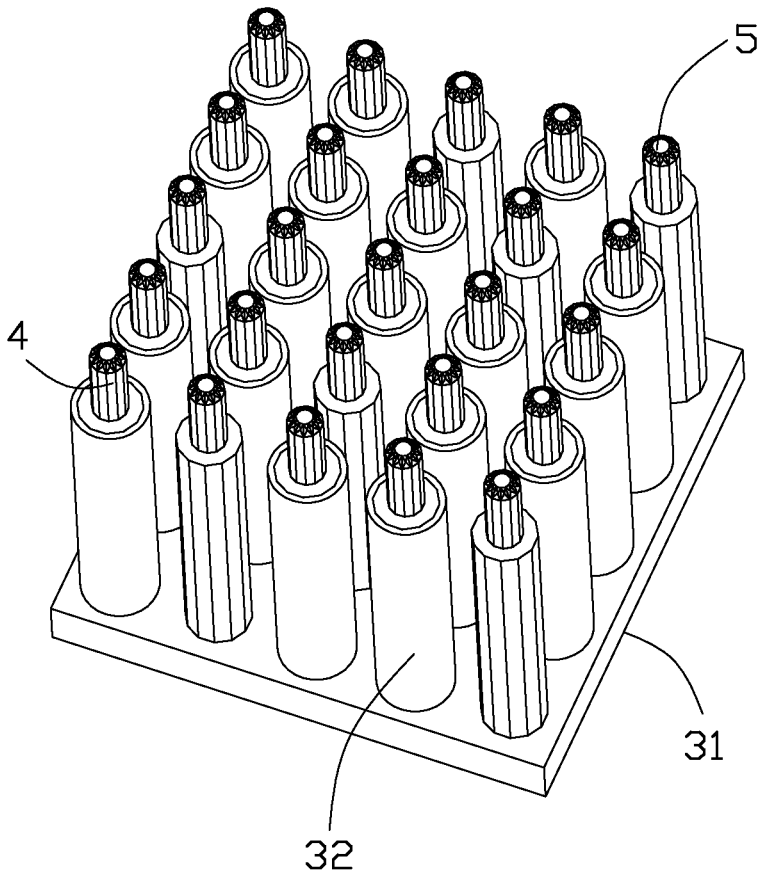
FIG. 2 is an isometric view of part members of an electrical connector according to a preferred embodiment of the present invention, showing insulative member and lower insulative member locating on the conductive contacts and grounding terminals.
Figure 3:
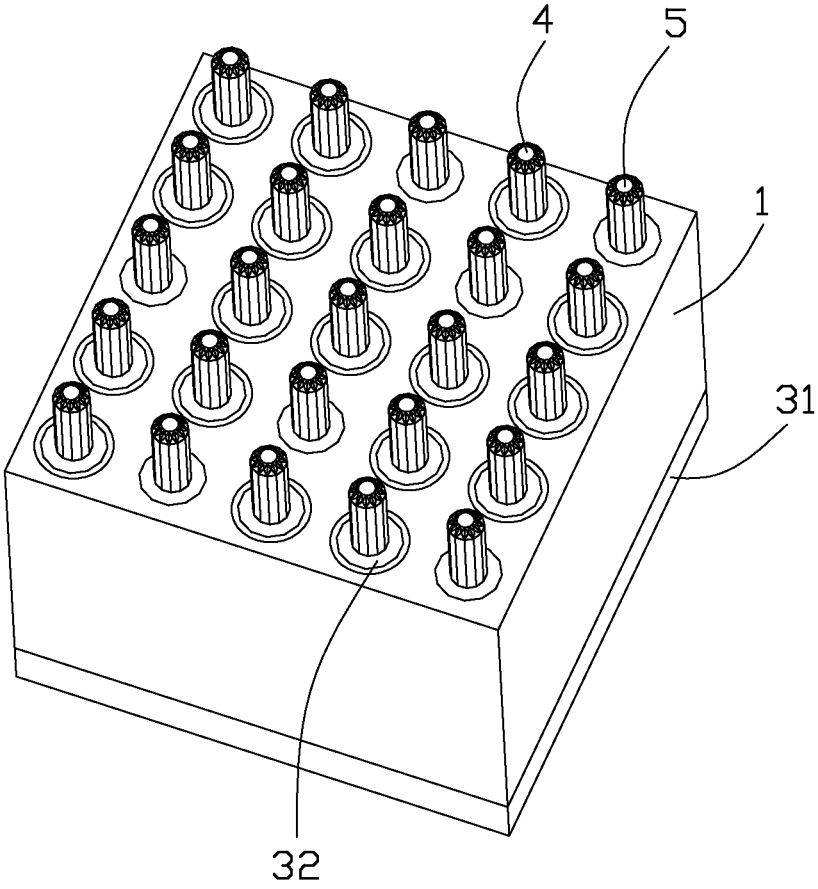
FIG. 3 is an isometric view of part members of an electrical connector according to a preferred embodiment of the present invention, showing an electrical member locating on the insulative member.

Referring to FIGS. 1-2 and FIG. 5, the conductive contact 4 is configured to a cylinder type and comprises a body portion 40, an upper end 41 extending upwardly from the body portion 40 and a lower end 42 extending downwardly from the body portion 40. The cross-sectional area of the body portion 40 is larger than that of the upper end 41 and that of the lower end 42. The free end of the upper end 41 defines an upper contact portion 410 and the free end of the lower end defines a lower contact portion 420.

The upper contact portion 410 extends beyond the upper insulative member 2 to electrically connecting with the IC package. The lower contact portion 420 extends beyond the lower insulative member 31 to electrically connecting with the substrate. The height of the insulative member 32 equals to that of the body portion 40 of the conductive contact 4 and that of the electrical member 1. The conductive contacts 4 are insulated from the electrical member 1. The grounding terminals 5 have a same structure with the conductive contacts 4 and are electrically connected with the electrical member 1.

Referring to FIGS. 1-4, the electrical connector 100 is made by insert-molded method. The steps are as following: firstly, providing a number of conductive contacts 4 and a number of grounding terminals 5; secondly, providing an insulative member 32 and a lower insulative member 31 made of insulation materials insert-molded with the conductive contacts 4 and the grounding terminals 5; thirdly, providing an electrical member 1 made of electrical resin located around the insulative member 32 and the grounding terminals 5 with insert-molded method, the conductive contacts 4 are insulated from the electrical member 1 and the grounding terminals 5 are electrically connected with the electrical member 1; then, providing an upper insulative member 2 made of insulation materials insert-molded with the conductive contacts 4 and the grounding terminals 5. The electrical connector 100 is easy to make and can save the cost.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an IC package with a substrate, comprising:

a number of conductive contacts;

a number of grounding terminals;

an insulative member made of insulation materials located around the conductive contacts with insert-molded method; and an electrical member made of electrical resin located around the insulative member and the grounding terminals with insert-molded method, the conductive contacts being insulated from the electrical member and the grounding terminals being electrically connected with the electrical member.

2. The electrical connector as claimed in claim 1, wherein the electrical resin is made of liquid crystal polyester.

3. The electrical connector as claimed in claim 1, wherein further includes a lower insulative member locates on lower end of the electrical member.

4. The electrical connector as claimed in claim 3, wherein the lower insulative member and the insulative member are made in a same time to position the conductive contacts and the grounding terminals.

5. The electrical connector as claimed in claim 3, wherein further includes an upper insulative member locates on upper end of the electrical member.

6. The electrical connector as claimed in claim 5, wherein the conductive contact includes a body portion located in the insulative member, an upper contact portion extending beyond the upper insulative member and a lower contact portion extending beyond the lower insulative member.

7. The electrical connector as claimed in claim 6, wherein the grounding terminals have a same structure with the conductive contacts.

8. The electrical connector as claimed in claim 6, wherein the height of the insulative member equals to that of the body portion of the conductive contact and that of the electrical member.

9. A method for making an electrical connector, comprising the steps of:

S1) providing a number of conductive contacts and a number of grounding terminals;

S2) providing an insulative member made of insulation materials located around the conductive contacts with insert-molded method; and S3) providing an electrical member made of electrical resin located around the insulative member and the grounding terminals with insert-molded method, the conductive contacts being insulated from the electrical member and the grounding terminals being electrically connected with the electrical member.

10. The method as claimed in claim 9, wherein the electrical resin is made of liquid crystal polyester.

11. The method as claimed in claim 9, wherein further includes a step to provide a lower insulative member locates on lower end of the electrical member.

12. The method as claimed in claim 11, wherein further includes a step to provide an upper insulative housing locates on upper end of the electrical member with insert-molded method.

13. The method as claimed in claim 11, wherein the lower insulative member and the insulative member are made in a same step to position the conductive contacts and the grounding terminals.

14. The method as claimed in claim 13, wherein the conductive contact includes a body portion located in the insulative member, an upper contact portion extending beyond the upper insulative member and a lower contact portion extending beyond the lower insulative member.

15. The method as claimed in claim 14, wherein the grounding terminals have a same structure with the conductive contacts.

16. The method as claimed in claim 14, wherein the height of the insulative member equals to that of the body portion of the conductive contact and that of the electrical member.

17. An electrical connector comprising:

a plurality of conductive contacts each circumferentially surrounded by an insulative sleeve via a first insert molding with two opposite ends exposed to an exterior in a vertical direction; and said contacts associated with the corresponding sleeves further integrally embedded within a conductive housing made of conductive resin, via a second insert molding; wherein the contacts are isolated from the conductive housing by the corresponding sleeves which intimately mechanically and electrically contact the conductive housing under proper securement therebetween.

18. The electrical connector as claimed in claim 17, wherein the securement between the sleeve and the conductive housing performs elasticity thereof.

19. The electrical connector as claimed in claim 17, further including other contacts without corresponding sleeves associated therewith and directly mechanically and electrically circumferentially connected to the conductive housing for grounding.

20. The electrical connector as claimed in 17, wherein two opposite ends of each of said contacts are narrowed and covered by corresponding insulative parts, respectively, for anti-shorting consideration.

* * * * *